US007468625B2

(12) United States Patent
Koizumi et al.

(10) Patent No.: US 7,468,625 B2
(45) **Date of Patent: *Dec. 23, 2008**

(54) SEMICONDUCTOR DEVICE INCLUDING CURRENT MIRROR CIRCUIT

(75) Inventors: Masayuki Koizumi, Kanagawa-ken (JP); Hiroyuki Shibayama, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/773,996

(22) Filed: Jul. 6, 2007

(65) Prior Publication Data

US 2008/0012630 A1 Jan. 17, 2008

Related U.S. Application Data

(63) Continuation of application No. 11/171,316, filed on Jul. 1, 2005, now Pat. No. 7,248,100.

(30) Foreign Application Priority Data

Jul. 2, 2004 (JP) ..... 2004-196159

(51) Int. Cl.
*G05F 1/10* (2006.01)

(52) U.S. Cl. ..... 327/543

(58) Field of Classification Search ..... 323/315, 323/316; 327/403, 404, 535, 537, 538, 543
See application file for complete search history.

(56) References Cited

U.S. PATENT DOCUMENTS

| | | | | |
|---|---|---|---|---|
| 3,982,172 | A | 9/1976 | Van De Plassche | |
| 4,608,530 | A | 8/1986 | Bacrania | |
| 5,661,383 | A | 8/1997 | Schlager et al. | |
| 6,462,527 | B1 | 10/2002 | Maneatis | |
| 6,577,181 | B2 * | 6/2003 | Takahashi | 327/538 |
| 7,012,597 | B2 | 3/2006 | Kasai | |
| 7,064,696 | B2 | 6/2006 | Ohkubo et al. | |
| 7,071,771 | B2 | 7/2006 | Takano et al. | |

OTHER PUBLICATIONS

Behzad Razavi, "Design of Analog CMOS Integrated Circuits", pp. 135-139.

* cited by examiner

*Primary Examiner*—Jeffrey S Zweizig
(74) *Attorney, Agent, or Firm*—Oblon, Spivak, McClelland, Maier & Neustadt, P.C.

(57) ABSTRACT

A semiconductor device including a plurality of current mirror circuits is disclosed. The current mirror circuits having reference input terminals and output terminals respectively. Each of the reference input terminals is provided with a current having a different current value. Each of the output terminals of the current mirror circuits are connected to a current output terminal. The output currents of the current mirror circuits are controlled by a control circuit.

4 Claims, 3 Drawing Sheets

SEMICONDUCTOR DEVICE INCLUDING CURRENT MIRROR CIRCUIT

CROSS REFERENCE TO RELATED APPLICATIONS

The present continuation application claims the benefit of priority under 35 U.S.C. §120 application Ser. No. 11/171,316, filed Jul. 1, 2005, now U.S. Pat. No. 7,248,100, and under 35 U.S.C. §119 from Japanese Patent Application No. 2004-196159, filed on Jul. 2, 2004, the entire contents of both are incorporated herein by reference.

FIELD OF THE INVENTION

The present invention relates to a semiconductor device including a current mirror circuit.

DESCRIPTION OF THE BACKGROUND

A current multiplication circuit using a current mirror circuit has been widely used as a constant current circuit for use of a bias circuit requiring a large output current or an active load. A conventional current multiplication circuit is disclosed in Japanese Patent Publication (Kokai) No. 11-234135.

In the current multiplication circuit disclosed in the Publication, a plurality of output transistors of a current mirror circuit are connected in parallel so that the output current may have a desired value.

In a portable device typified by a cellular phone, it has been required at a transmission output stage that a bias current circuit covers an output current (a bias current) having a dynamic range of two to three digits. Furthermore, in such an application, there is a limitation that, in order to suppress switching noises to be produced at the time a bias current is switched, it is necessary to avoid turning on and off a plurality of output transistors of a bias current circuit simultaneously. Therefore, it is difficult to adopt a decode system to select an output transistor, so that it is necessary to connect output transistors of the number equivalent to required current steps in parallel.

However, in the conventional current multiplication circuit as described above, there has been an essential problem that a layout area increases in proportion to a ratio of an output current to a reference current. Particularly, a problem arises in the case where the output transistors connected in parallel are selected sequentially by means of switches in order to suppress the switching noises. The problem is that the layout area increases to the extent that the bias current circuit occupies a large portion of a core circuit, when the bias current circuit covers a wide dynamic range, for example, several hundreds μA to several tens mA.

SUMMARY OF THE INVENTION

According to an aspect of the present invention, a semiconductor device is provided which comprises a plurality of current mirror circuits respectively having an output terminal and a reference input terminal which is provided with a current having a different current value, a current output terminal connected to each of the output terminals of the current mirror circuits, and a control circuit to control output currents of the current mirror circuits.

DETAILED DESCRIPTION OF THE INVENTION

An embodiment of the present invention will be described with reference to the accompanying drawings below.

Figure 1:
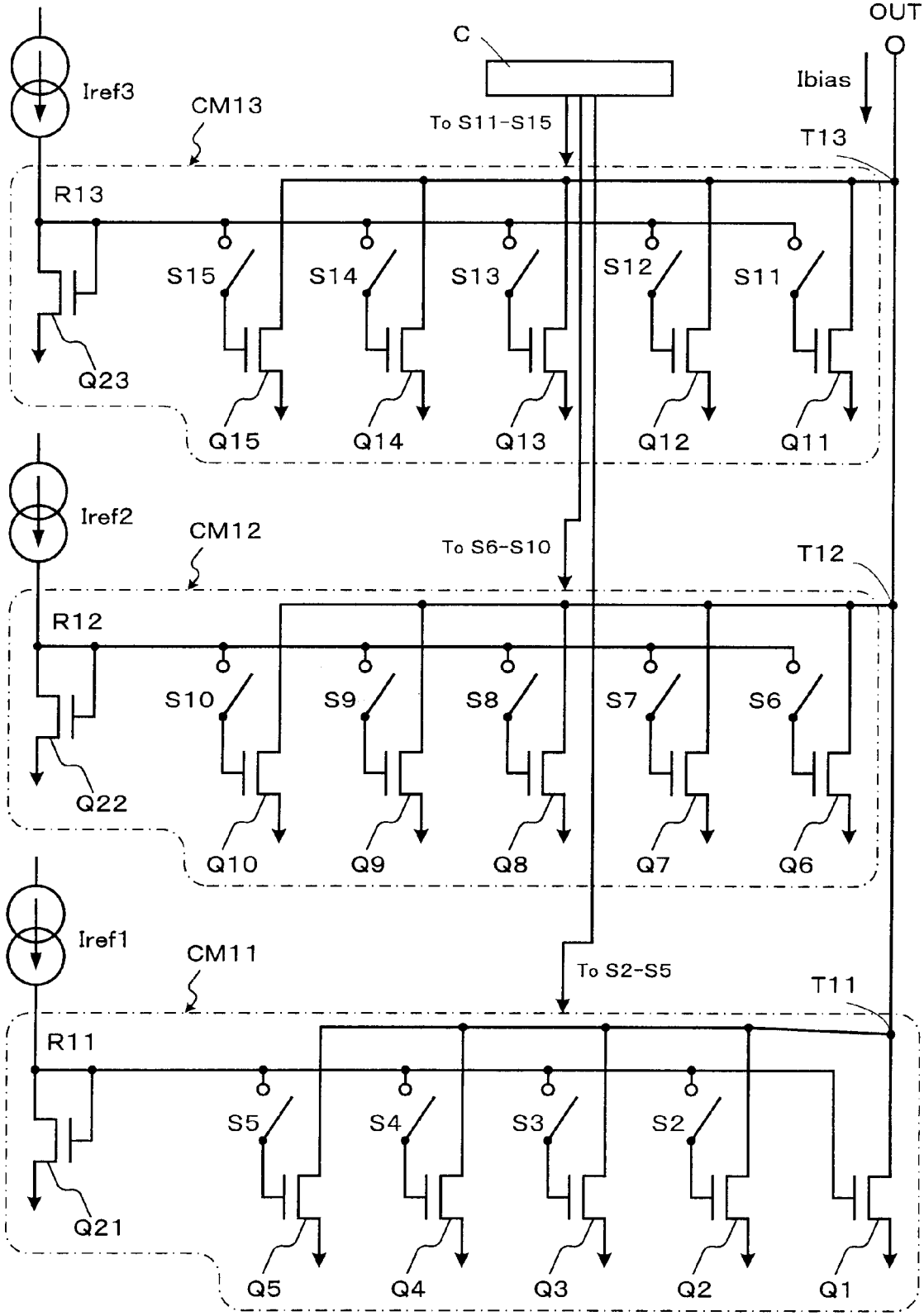
FIG. 1 is a circuit diagram showing a semiconductor device according to an embodiment of the present invention.

FIG. 1 is a circuit diagram showing a semiconductor device according to an embodiment of the present invention. The semiconductor device generates a current value of fifteen steps increasing exponentially. The semiconductor device is provided with three current mirror circuits CM11 to CM13 and control circuit C. The current mirror circuits CM11 to CM13 include reference transistors Q21 to Q23, output transistors Q1 to Q15 and switching elements S2 to S15. The control circuit C provides control signal CONT of 14 bits to the switching elements S2 to S15. The reference transistors Q21 to Q23 and the output transistors Q1 to Q15 are an N-channel type transistor, for example, a N-channel type MOS FET.

The reference input terminals of the current mirror circuits CM11 to CM13 are respectively provided with reference currents Iref1 to Iref3 having different current values.

The reference current Iref1 is provided to the reference input terminal R11 of the current mirror circuit CM11. The current mirror circuit CM11 has an output terminal T11 connected to a current output terminal OUT.

The reference current Iref2 is provided to the reference input terminal R12 of the current mirror circuit CM12. The current mirror circuit M12 has an output terminal T12 connected to the current output terminal OUT.

The reference current Iref3 is provided to the reference input terminal R13 of the current mirror circuit CM13. The current mirror circuit CM13 has an output terminal T13 connected to the current output terminal OUT.

The current mirror circuit CM11 includes the reference transistor Q21 connected to the reference input terminal R11, and the five output transistors Q1 to Q5 connected to the output terminal T11.

Drain and gate terminals of the output transistor Q21 are connected to the reference input terminal R11 of the current mirror circuit CM11. A source terminal of the output transistor Q21 is connected to a power supply (hereinafter referred to as "Vss").

The drain terminal of the output transistor Q1 is connected to the output terminal T11 of the current mirror circuit CM11. The gate terminal of the output transistor Q1 is connected to the drain terminal of the reference transistor Q21. The source terminal of the output transistor Q1 is connected to the Vss.

The drain terminal of the output transistor Q2 is connected to the output terminal T11 of the current mirror circuit CM11. The gate terminal of the output transistor Q2 is connected to the drain terminal of the reference transistor Q21 through the switching element S2. The source terminal of the output transistor Q2 is connected to the Vss.

The output transistors Q3 to Q5 are connected to the output terminal T11, the switching elements S3 to S5, the drain terminal of the reference transistor Q21 and the Vss respectively as in the case of the output transistor Q2. Gate terminals of the output transistors Q3 to Q5 are respectively connected to a drain terminal of the reference transistor Q21 through the switching elements S3 to S5.

The switching elements S2 to S5 are turned ON/OFF based on a control signal CONT of 14 bits being provided from a control circuit C to switch a mirror ratio. By the control signal CONT [2:5], value of a mirror current flowing through the output terminal T11 of the current mirror circuit CM11 is controlled.

The expression "control signal CONT [2:5]" implies that four bits among a control signal CONT [2:15] of 14 bits are used to control the switching elements S2 to S5. The same is applied to the expressions "CONT [6:10]" and "CONT [11:15]" which will be described hereinafter.

The current mirror circuit CM12 includes a reference transistor Q22 connected to the reference input terminal R12 and the five output transistors Q6 to Q10 connected to the output terminal T12.

Drain and gate terminals of the reference transistor Q22 are connected to the reference input terminal R12 of the current mirror CM12. The source terminal of the output transistor Q22 is connected to the Vss.

A drain terminal of the output transistor Q6 is connected to the output terminal T12 of the current mirror circuit CM12. The gate terminal of the output transistor Q6 is connected to the drain terminal of the reference transistor Q22 through the switching element S6. The source terminal of the output transistor Q6 is connected to the Vss.

The output transistors Q7 to Q10 are connected to the output terminal T12, the switching elements S7 to S10, the drain terminal of the reference transistor Q22 and the Vss respectively as in the case of the output transistor Q6. The gate terminals of the output transistors Q7 to Q10 are respectively connected to the drain terminal of the reference transistor Q22 through the switching elements S7 to S10.

The switching elements S6 to S10 are turned ON/OFF based on the control signal CONT [6:10]. By the control signal CONT [6:10], value of a mirror current flowing through the output terminal T12 of the current mirror circuit CM12 is controlled.

The current mirror circuit CM13 includes the reference transistor Q23 connected to the reference input terminal R12 and the five output transistors Q11 to Q15 connected to the output terminal T13.

A structure of the current mirror circuit CM13 is the same as that of the current mirror circuit CM12. The gate terminals of the output transistors Q11 to Q15 are connected to the drain terminal of the reference transistor Q23 via the switching elements S11 to S15. The switching elements S11 to S15 are turned ON/OFF based on the control signal CONT [11:15]. By the control signal CONT [11:15], value of a mirror current flowing through the output terminal T13 of the current mirror circuit CM13 is controlled.

Table 1 shows examples of sizes of the transistors and current values flowing through the output transistors Q1 to Q15 shown in FIG. 1.

TABLE 1

| Reference Current (mA) | Output transistor | Size Ratio | Current Value (mA) |
|---|---|---|---|
| 0.1 | Q1 | 1.00 | 0.1 |
| (Iref1) | Q2 | 1.41 | 0.141 |
| | Q3 | 2.00 | 0.2 |
| | Q4 | 2.83 | 0.283 |
| | Q5 | 4.00 | 0.4 |

TABLE 1-continued

| Reference Current (mA) | Output transistor | Size Ratio | Current Value (mA) |
|---|---|---|---|
| 0.4 | Q6 | 1.41 | 0.566 |
| (Iref2) | Q7 | 2.00 | 0.8 |
| | Q8 | 2.83 | 1.131 |
| | Q9 | 4.00 | 1.6 |
| | Q10 | 5.66 | 2.263 |
| 1.6 | Q11 | 2.00 | 3.2 |
| (Iref3) | Q12 | 2.83 | 4.525 |
| | Q13 | 4.00 | 6.4 |
| | Q14 | 5.66 | 9.051 |
| | Q15 | 8.00 | 12.8 |

In Table 1, the sizes of the output transistors Q1 to Q15 are represented by a ratio at the time when sizes of the output transistors Q21 to Q23 are set to 1. Accordingly, the respective current values flowing through the output transistors Q1 to Q15 are (reference current)×(size ratio) when the output transistors Q1 to Q15 are in an ON state. Here, the reference current is each of Iref1 to Iref3.

For example, the current value flowing through the output transistor Q13 is 1.6 mA×4.00 (=6.4 mA) when the output transistor Q13 is in an ON state, as shown in Table 1.

An operation of the semiconductor device having the above described structure will be described.

The turning ON/OFF of the output transistors Q2 to Q15 is controlled based on the control signal CONT. The output transistors which have been turned ON generate mirror currents corresponding to the size ratios of the output transistors Q2 to Q15 at the output terminals T11 to T13.

Since the output terminals T11 to T13 of the current mirror circuits CM11 to CM13 are connected to the current output terminal OUT, the total sum of the mirror currents, which are generated by the output transistors in an ON state, flows through the OUT as a bias current Ibias to apply to a power amplifier, for example.

Table 2 shows a relation between a bias current Ibias and the sum of the layout areas of the output transistors in an ON state in each step corresponding to the number of the output transistors which are in an ON state.

TABLE 2

| Step | bias current Ibias (mA) | Layout Area ($\mu m^2$) |
|---|---|---|
| 1 | 0.1 | 1.00 |
| 2 | 0.241 | 2.41 |
| 3 | 0.441 | 4.41 |
| 4 | 0.724 | 7.24 |
| 5 | 1.124 | 11.24 |
| 6 | 1.69 | 12.66 |
| 7 | 2.49 | 14.66 |
| 8 | 3.621 | 17.49 |
| 9 | 5.221 | 21.49 |
| 10 | 7.484 | 27.14 |
| 11 | 10.684 | 29.14 |
| 12 | 15.21 | 31.97 |
| 13 | 21.61 | 35.97 |
| 14 | 30.661 | 41.63 |
| 15 | 43.461 | 49.63 |

Herein, the ON/OFF states of the switching elements S2 to S15 correspond uniquely to each state of the steps. The state transition from a step to another step always occurs one by one. In other words, the number of the output transistors Q2 to Q15 in ON or OFF state increases or decreases one by one. Each of the output transistors Q2 to Q15 is turned on or off in a predetermined order. The output transistors Q2 to Q15 are turned on or off one after adjacent another. In the semiconductor device, time intervals are provided among the switching timings of the output transistors Q2 to Q15.

As shown in Table 2, the states of the steps maybe regarded as a one-dimensional sequence. Accordingly, the state transition is always limited to that transiting to an adjacent state. Turning ON/OFF of the switching elements S2 to S15 is selective, and more than one transition is not performed simultaneously. This is because switching noises at the time of switching the bias current Ibias is suppressed as possible.

For example, the step 8 corresponds to the operation of the switching element S8. When the step transits from the state 7 to the state 8, the switching element S8 is turned ON. When the step transits from the state 8 to the state 7, the switching element S8 is turned OFF.

Furthermore, when the step transits from the state 8 to the state 9, or when the step transits from the state 9 to the state 8, the switching element S8 keeps its ON state.

Accordingly, when the step takes the state 8, all of the switching elements S2 to S8 are in an ON state, and all of the switching elements S9 to S15 are in an OFF state. Therefore, bias current Ibias is the total sum of the mirror currents flowing through the output transistors Q1 to Q8.

As shown in Table 1, the transistor sizes of the output transistors Q1 to Q5, the transistor sizes of the output transistors Q6 to Q10, and the transistor sizes of the output transistors Q11 to Q15 are set so as to form a geometric progression. The reference currents Iref1 to Iref3 are also set so as to form a geometrical progression.

Accordingly, the bias current Ibias increases geometrically in accordance with the increase of the number of the step as follows.

$$Ibias=0.1\times\Sigma 2^{(s-1)/2}(mA) \quad (1)$$

where s is a number indicating the state of the step shown in Table 2.

Furthermore, since the three reference currents having the different current values, that is, Iref1 equals to 0.1 mA, Iref2 equals to 0.4 mA and Iref3 equals to 1.6 mA, are used in the semiconductor device according to the embodiment of the present invention, it is possible to suppress the sum of the layout areas of the output transistors drastically.

Figure 2:
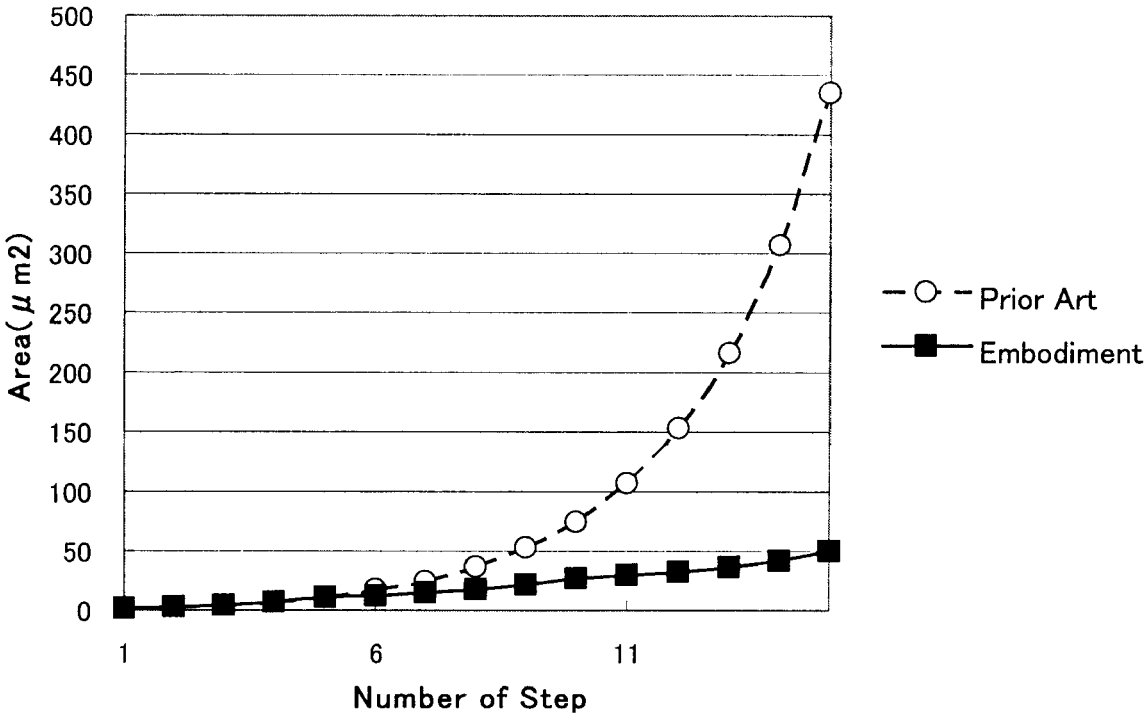
FIG. 2 is a graph showing a relation between steps and layout areas in the semiconductor device according to the embodiment of the present invention.

FIG. 2 is a graph showing a suppression effect of the layout area in the semiconductor device according to the embodiment of the present invention.

In FIG. 2, the solid line indicates the layout area of the embodiment, and the dashed line indicates a layout area of a conventional semiconductor device having the equal dynamic range and the equal number of steps. The horizontal axis represents numbers indicating the states of the step shown in Table 2, and the vertical axis represents the total sum of the layout areas of the output transistors which are in the an ON state in the respective steps.

From this graph, according to the embodiment, it is seen that the layout area can be reduced approximately to 1/10 compared with the conventional circuit structure having the dynamic range equal to the embodiment of the present invention. The reduction of the layout area may arise because different reference currents are employed in the embodiment.

According to the above described embodiment, since the size of the output transistor occupying the large part of the layout area may be suppressed drastically, it is possible to realize the semiconductor device having a wide dynamic range of output current while increase of the layout area is suppressed.

Furthermore, according to the embodiment, since more than one transistor is not turned ON/OFF simultaneously, it is possible to reduce the switching noises at the time of switching of the output current drastically.

Figure 3:
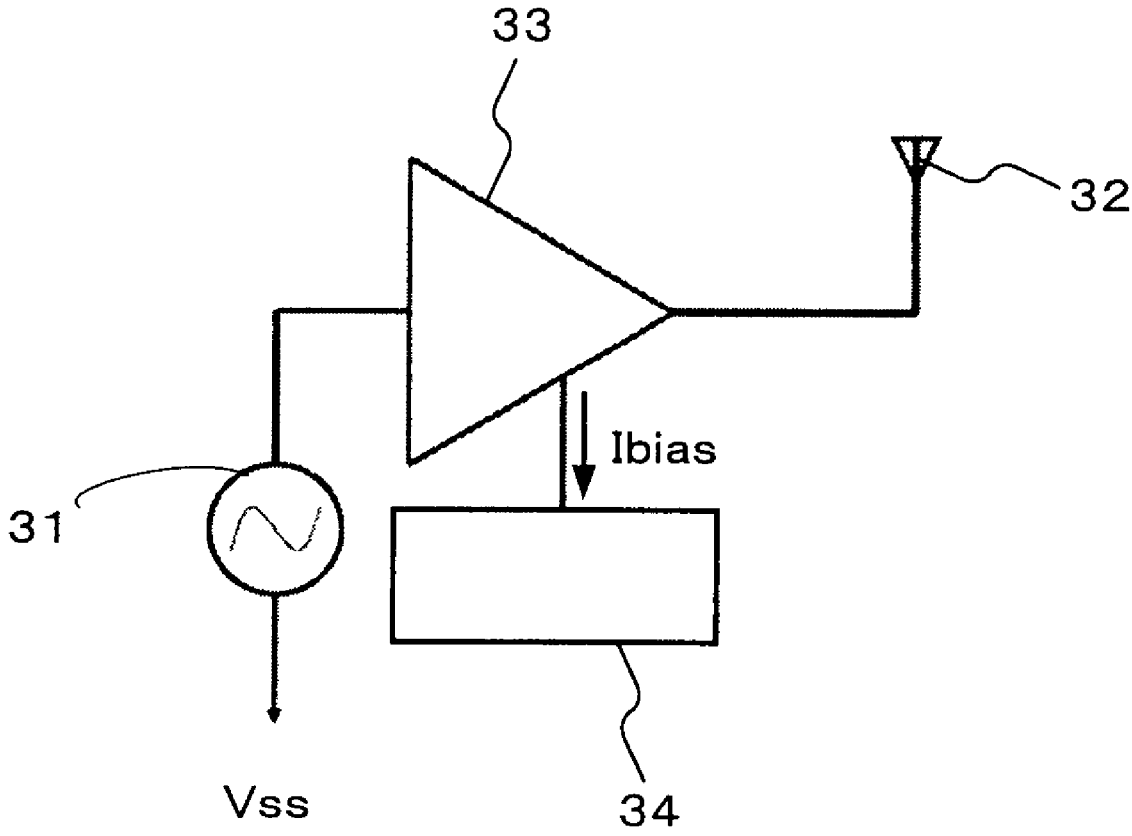
FIG. 3 is a block diagram showing a transmission output circuit using the semiconductor device according to the embodiment of the present invention.

FIG. 3 is a block diagram showing a transmission output circuit using the semiconductor device according to the embodiment of the present invention.

In FIG. 3, a power is provided to a transmission output circuit 33 from an alternate power supply 31. The transmission output circuit 33 may be a power amplifier. The transmission output circuit 33 provides an output signal to an external antenna 32. The gain of the transmission output circuit 33 is controlled by a bias current circuit 34. By adopting this embodiment as the bias current circuit 32, it is possible to realize the transmission output circuit having a wide output dynamic range while increase of the layout area is suppressed.

In the foregoing embodiment, the circuit example is shown, which realizes the bias current Ibias shown in equation (1) with the 15 steps. The present invention is not limited to this, and the present invention may be applicable to any semiconductor device principally as long as the semiconductor device is a current circuit simulating a monotonously increasing function. The output of the current output terminal OUT may be utilized as various currents other than the bias current. Furthermore, though the number of the output transistors of each of the current mirror circuits CM11 to CM13 is set to five, the present invention is not limited to this.

Furthermore, in the foregoing embodiment, though the three reference currents Iref1 to Iref3 which are quadruple to each other are used, the present invention is not limited to this. It is possible to mount a semiconductor device based on a bias current value to be targeted, the number of the steps and the layout area to be achieved.

Though the output transistor Q1 is always made to be turned ON irrespective of the state of the step, the present invention is not limited to this. The output transistor Q1 may be connected to Iref1 through a switching element as in the case of other output transistors. The output transistors Q2 to Q15 may be controlled by using switches to be provided in the control circuit C and which are controlled by the control signal, instead of switch elements S2 to S15.

What is claimed is:

1. A semiconductor device comprising:

a current mirror circuit having a reference input terminal and an output terminal, the current mirror circuit including, a first insulated gate type transistor having a first gate terminal connected to the reference input terminal, a first drain terminal connected to the reference input terminal and a first source terminal connected to a power supply, a plurality of second insulated gate type transistors having difference sizes respectively, each being provided with a second gate terminal, a second drain terminal connected to the output terminal and a second source terminal connected to the power supply, and a plurality of switching elements provided between the reference input terminal and one of the second gate terminals of the second insulated gate type transistors, and each being controlled by a control signal to be set to one of ON and OFF states.

2. A semiconductor device comprising:

a plurality of current mirror circuits having reference input terminals and output terminals respectively, each of the reference input terminals being provided with a current having a difference current value;

a current output terminal connected to each of the output terminals of the current mirror circuits; and a control circuit to output a control signal to control output currents of the current mirror circuits, wherein each of the current mirror circuits includes, a first insulated gate type transistor having a first gate terminal connected to one of the reference input terminals, a first drain terminal connected to one of the reference input terminals and a first source terminal connected to a power supply, a plurality of second insulated gate type transistors, each having a second gate terminal, a second drain terminal connected to one of the output terminals and a second source terminal connected to the power supply, and a plurality of switching elements, each being provided between a respective one of the reference input terminals and one of the second gate terminals of the second insulated gate type transistors, and each being controlled by the control signal to be set to one of ON and OFF states.

3. The semiconductor device according to claim 2, wherein each of the current mirror circuits has the same number of the second insulated gate type transistors.

4. The semiconductor device according to claim 2, wherein the second insulated gate type transistors of each of the current mirror circuits have different sizes.

* * * * *